US006425660B1

(12) United States Patent
Sherman et al.

(10) Patent No.: US 6,425,660 B1
(45) Date of Patent: Jul. 30, 2002

(54) DROPLET GENERATOR FOR A CONTINUOUS STREAM INK JET PRINT HEAD

(75) Inventors: Nigel Edward Sherman, Woolpit; Graham Dagnall Martin, Sawston; Sukbir Singh Pannu, Grantchester; Amanda Hazell East, Boxworth, all of (GB)

(73) Assignee: Marconi Data Systems Inc., Wood Dale, IL (US)

( * ) Notice: Subject to any disclaimer, the term of this patent is extended or adjusted under 35 U.S.C. 154(b) by 0 days.

(21) Appl. No.: 09/423,497

(22) PCT Filed: Apr. 29, 1998

(86) PCT No.: PCT/GB98/01254

§ 371 (c)(1),
(2), (4) Date: Feb. 24, 2000

(87) PCT Pub. No.: WO98/51503

PCT Pub. Date: Nov. 19, 1998

(30) Foreign Application Priority Data

May 9, 1997 (GB) ..... 9709462

(51) Int. Cl.[7] ..... B41J 2/025; B41J 2/02
(52) U.S. Cl. ..... 347/75
(58) Field of Search ..... 347/68, 54, 20, 347/73, 74, 75

(56) References Cited

U.S. PATENT DOCUMENTS 4,167,742 A * 9/1979 Head ..... 347/75
4,550,325 A * 10/1985 Viola ..... 347/68
4,554,559 A * 11/1985 Heath ..... 347/199
5,502,473 A * 3/1996 East et al. ..... 347/73

FOREIGN PATENT DOCUMENTS

DK 0 624 469 A1 * 11/1994 ..... B41J/2/025

* cited by examiner

*Primary Examiner*—Huan Tran
(74) *Attorney, Agent, or Firm*—Piper Marbury Rudnick & Wolfe; Joel H. Bootzin

(57) ABSTRACT

A droplet generator for a continuous stream ink jet print head has a cavity for containing ink, and nozzle orifices passing ink from the cavity to form jets. An actuator means vibrates the ink in the cavity such that each jet breaks up into ink droplets. The actuator means is disposed on the opposite side of the cavity to the nozzle orifices, and a surrounding wall of the cavity extends between the actuator means and nozzle orifices for containing the ink therebetween. The surrounding wall has inner and outer constituent wall. The resistive component of the wave impedance of the outer wall passively damps vibration of the inner wall by dissipating its vibration; the reactive component of the wave impedance of the outer wall actively restrains vibration of the inner wall, ensuring that each jet breaks up into ink droplets at the same predetermined distance from its respective nozzle orifice.

10 Claims, 2 Drawing Sheets

DROPLET GENERATOR FOR A CONTINUOUS STREAM INK JET PRINT HEAD

TECHNICAL FIELD OF THE INVENTION

This invention relates to a droplet generator for a continuous stream ink jet print head.

BACKGROUND

A conventional droplet generator has an elongate cavity for containing the ink and nozzle orifices communicating from within to without the cavity for passing ink from the cavity to form jets. The nozzle orifices extend along the length of the cavity. An actuator means vibrates the ink in the cavity such that each jet ideally breaks up into ink droplets at the same predetermined distance from its respective nozzle orifice. The actuator means is disposed on the opposite side of the cavity to the nozzle orifices, and a surrounding wall of the cavity extends between the actuator means and the nozzle orifices for containing the ink between the actuator and the nozzle orifices.

In one known generator as described in the previous paragraph, the nozzle orifices are formed in a stainless steel foil sheet which is bonded to a stainless steel plate which is bolted by means of stainless steel bolts to a stainless steel manifold.

A problem with this known generator is that vibration of the various constituent parts of the generator is communicated to the ink cavity, and hence may perturb the uniform break up of the jets along the length of the cavity. A further problem with this known generator is the time consuming adjustment of the tightness of the bolts during set up of the generator. This adjustment is required to minimize vibration of the foil sheet, and thereby minimize variation in jet break up distance from the generator along the length of the cavity. In addition, tightening the bolts can distort the plate to which the foil sheet is secured, hence undesirably stretching the foil sheet. The known generator is also sensitive to mechanical and thermal stresses in its structure.

A droplet generator of the kind described in the preceding paragraph is disclosed in WO-A-9006850.

SUMMARY OF THE INVENTION

According to the present invention there is provided a droplet generator for a continuous stream ink jet print head comprising: an elongate cavity for containing the ink; nozzle orifices communicating from within to outside of said cavity for passing ink from the cavity to form jets, said nozzle orifices extending along the length of said cavity; actuator means for vibrating the ink in said cavity such that each said jet breaks up into ink droplets at the same predetermined distance from its respective nozzle orifice, said actuator means being disposed on the opposite side of said cavity to said nozzle orifices; and extending between said actuator means and said nozzle orifices a surrounding wall of said cavity for containing the ink between said actuator means and said nozzle orifices, characterised in that said surrounding wall comprises inner and outer constituent walls, the resistive component of the wave impedance of said outer wall being such that the outer wall passively damps vibration of the inner wall by dissipating its vibration, the reactive component of the wave impedance of said outer wall being such that the outer wall actively restrains vibration of the inner wall, said outer wall thereby ensuring that each said jet breaks up into ink droplets at said same predetermined distance from its respective nozzle orifice.

Preferably, said actuator means is held in said generator by the outer wall of said surrounding wall.

Preferably, said cavity has a 'V' cross section defined by the interior faces of said inner wall, and said nozzle orifices extend along the open apex of said 'V' cross section cavity. The nozzle orifices may be formed in a laminar sheet which is secured to said inner wall such that the nozzle orifices extend along said open apex of the 'V' cross section cavity.

Preferably, said actuator means overlaps the ends and sides of said cavity where it addresses the cavity.

Preferably, said outer wall is a single piece moulded construction. Alternatively, said outer wall may be constructed from at least two parts secured together.

Preferably, said actuator means and said inner wall are push fitted in said outer wall.

Preferably, said inner wall is metal and said outer wall is plastic.

Preferably, said actuator means is designed to be resonant in operation of the generator, whereas said cavity is designed not to be.

BRIEF DESCRIPTION OF THE DRAWINGS

A droplet generator in accordance with the present invention will now be described, by way of example, with the accompanying drawings, in which.

DETAILED DESCRIPTION OF THE INVENTION

Figure 2:
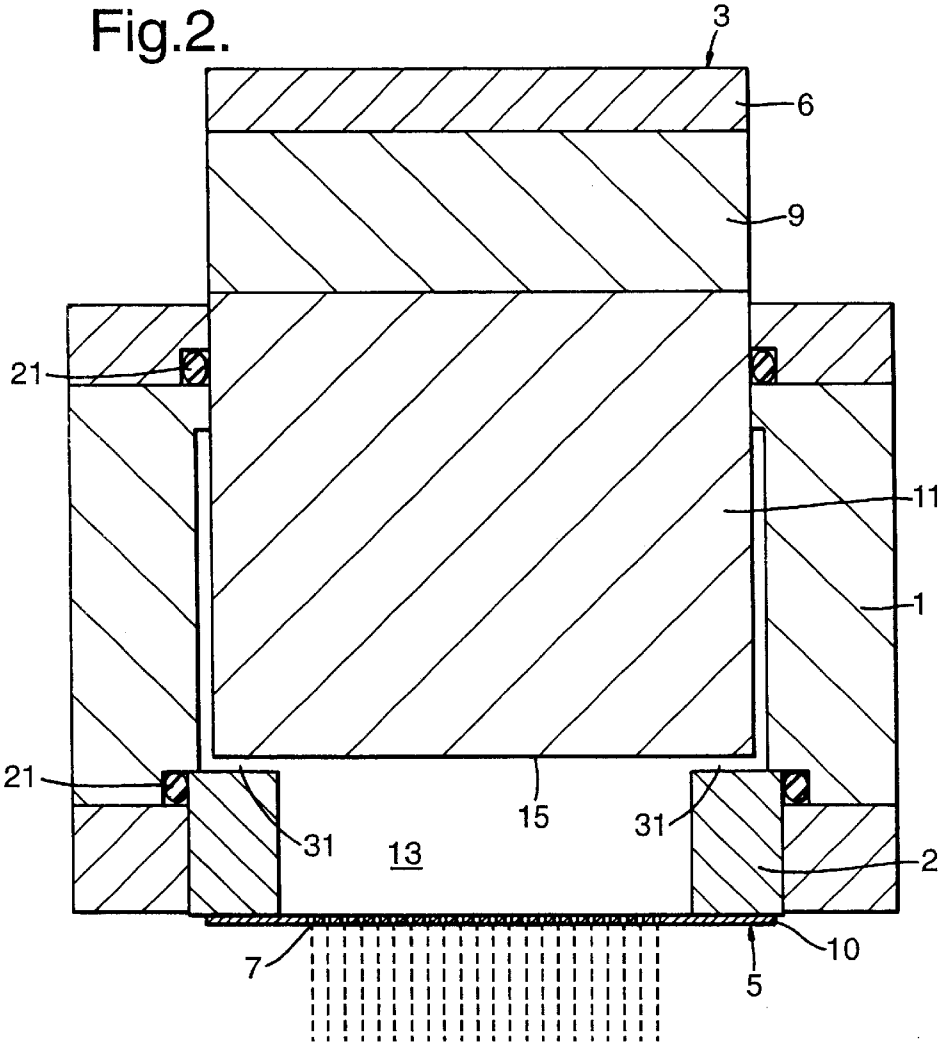
FIGS. 2, 3 and 4 are side, plan and underneath views respectively of the generator of FIG. 1.
Figure 1:
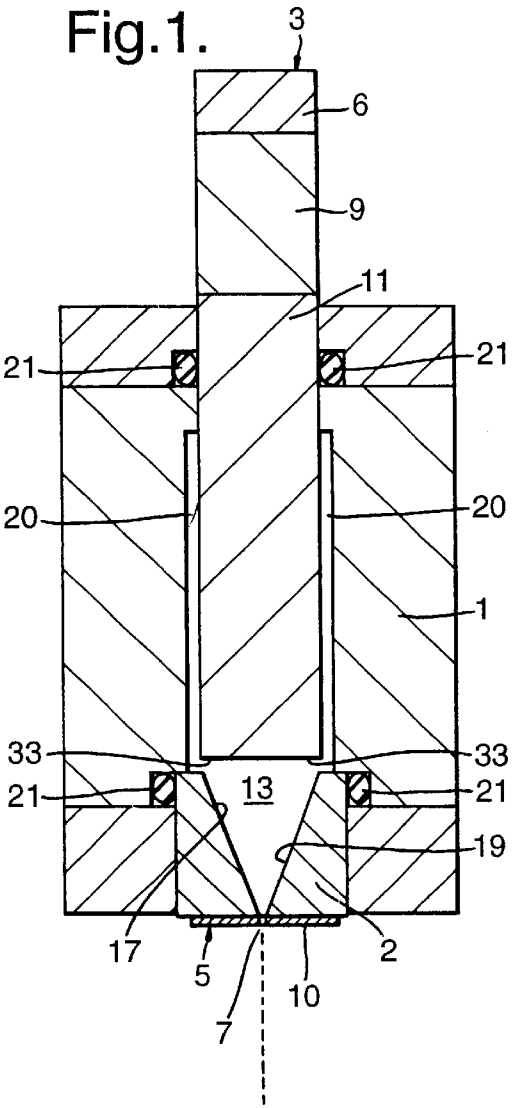
FIG. 1 is an end view of the generator.
Figure 3:
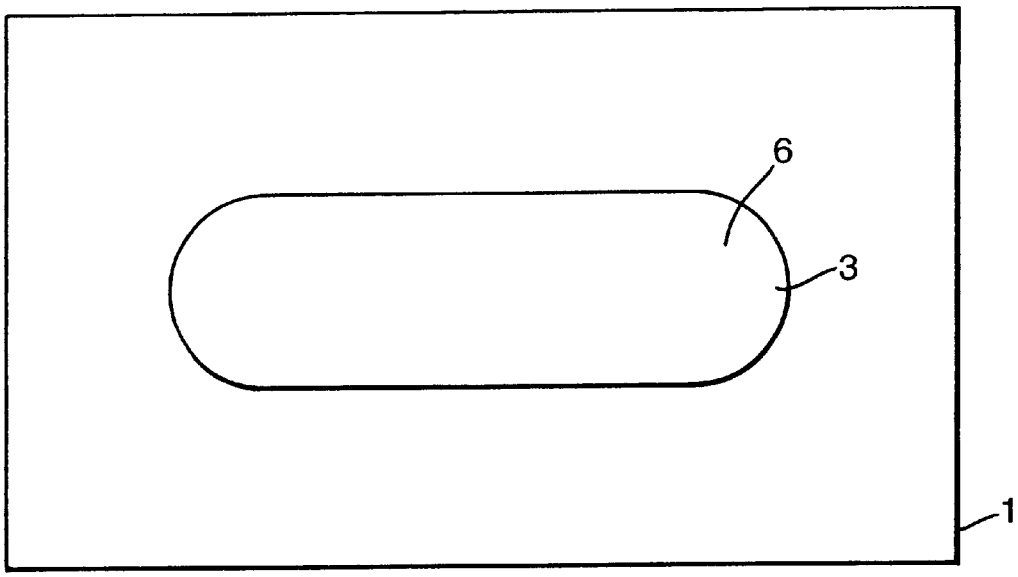

Referring to the drawings, the generator comprises a polyetheretherketone manifold 1, and push fitted therein, an actuator 3 and a nozzle carrier 5. Actuator 3 comprises a piezoelectric driver 9, a stainless steel head 11 and a brass backing member 6. Nozzle carrier 5 comprises a stainless steel element 2 defining therein a 'V' cross section channel, and bonded to element 2, a stainless steel foil sheet 10. Sheet 10 contains a line of nozzle orifices 7, and is so bonded to element 2 that this line runs along the length of the open apex of the 'V' cross section channel of element 2.

An elongate ink cavity 13 is defined by the lower face 15 of actuator 3 and interior faces 17, 19 of element 2 which define the 'V' cross section channel of element 2. A narrow gap 20 is present on either side of head 11 of actuator 3 between it and manifold 1. 'O' rings 21 seal against the further eggression of ink from cavity 13 and gaps 20. Thus, piezoelectric driver 9 is sealed from contact with the ink. Channels (not shown) are provided in manifold 1 and communicate with gaps 20 for the supply of ink to cavity 13 and the bleeding of air/ink from cavity 13.

Manifold 1 and element 2 can be considered to constitute outer and inner walls respectively of a surrounding wall of cavity 13, which surrounding wall extends between actuator 3 and nozzle orifices 7 and contains the ink therebetween.

At the frequency of operation of the generator, actuator 3 has a resonant frequency at which all points across the lower face 15 of actuator 3 vibrate vertically in phase and with the same amplitude, i.e. at which lower face 15 is driven in contact with the ink in cavity 13 in piston-like manner. Thus, actuator 3 vibrates the ink in cavity 13 such that each ink jet breaks up into ink droplets at the same predetermined distance from its respective nozzle orifice 7.

Cavity 13 is shaped so as to provide a steady and essentially unidirectional flow of ink to nozzle orifices 7.

Variation of the temperature/composition of the ink will vary the speed at which sound travels in it, and this variation may be large enough to produce unwanted modes of vibration of the ink in cavity 13 which travel along the length of cavity 13. This results in uneven jet break up length, making charging and deflecting the ink droplets for printing unmanageable. To address this problem actuator 3 runs the length of cavity 13 and overlaps the ends and sides of cavity 13 at 31 and 33 respectively.

Cavity 13 is dimensioned so as to be, in operation of the generator, non-resonant in its vertical dimension from lower face 15 of actuator 3 to the line of nozzle orifices 7. It can thus be used with different ink compositions and is not sensitive to change in temperature of the ink. Of course, a change in temperature/composition of the ink will change the jet break up length. This is compensated for by adjusting the pressure at which ink is supplied to the generator and/or the drive voltage applied to piezoelectric driver 9 of actuator 3.

The walls of ink cavity 13 must have a high acoustic impedance relative to the ink to minimize vibration loss from cavity 13. Thus, the walls of cavity 13 are constructed of stainless steel. However, any material having a suitably high acoustic impedance and chemically resistant to the ink may be used.

The wave impedance Z of a body is defined as the resistance of the body to a distribution of forces of a given wavelength presented to it. Z=R+jX, where R is a resistive component, X is a reactive component, and j is the square root of −1. R and X are dependent on the dimensions and material properties of the particular body concerned.

The resistive component of the wave impedance of manifold 1 must be such as to passively damp vibration of nozzle carrier 5 by dissipating effectively such vibration. The reactive component of the wave impedance of manifold 1 must be such as to actively restrain vibration of nozzle carrier 5. A suitable material for manifold 1 is polyetheretherketone. Examples of other suitable plastics are polyoxymethylene, polytetrafluoroethylene, glass fiber reinforced polyphenylenesulphide and glass fiber reinforced polybutyleneterephthalate. The passive damping and active restraining of nozzle carrier 5 by manifold 1 minimise to a high degree vibrations in carrier 5.

Manifold 1 may be either a single piece moulded construction, or in several parts for ease of assembly. In the case of several parts, it is to be noted that the means of joining the parts, e.g. bolts, glue, etc., will be inhibited from affecting the vibration in cavity 13 since manifold 1 and cavity 13 are acoustically decoupled by means of the intervening stainless steel nozzle carrier 5. For the same reason, any vibration established in manifold 1 will be inhibited from communicating to cavity 13. Further, the generator has a low sensitivity to mechanical and thermal stresses in manifold 1 due to the presence of nozzle carrier 5 and its higher stiffness as compared to manifold 1.

The push fitting of actuator 3 and nozzle carrier 5 into manifold 1 must be such that the resultant structure withstands the internal pressure in cavity 13, whilst, with regard to the push fitting of carrier 5, provides the required communication between carrier 5 and manifold 1 to achieve the passive damping and active restraining of carrier 5 by manifold 1.

Finite element analysis computer modelling shows that, if there is no passive damping or active restraining of carrier 5, it will, at the frequency of operation of the generator, exhibit a bending wave motion, i.e. its length will flex or bow in the vertical direction in FIG. 2. The following analysis assumes that it is this type of motion of carrier 5 which is presented to, and must be damped and restrained by, manifold 1.

Figure 4:
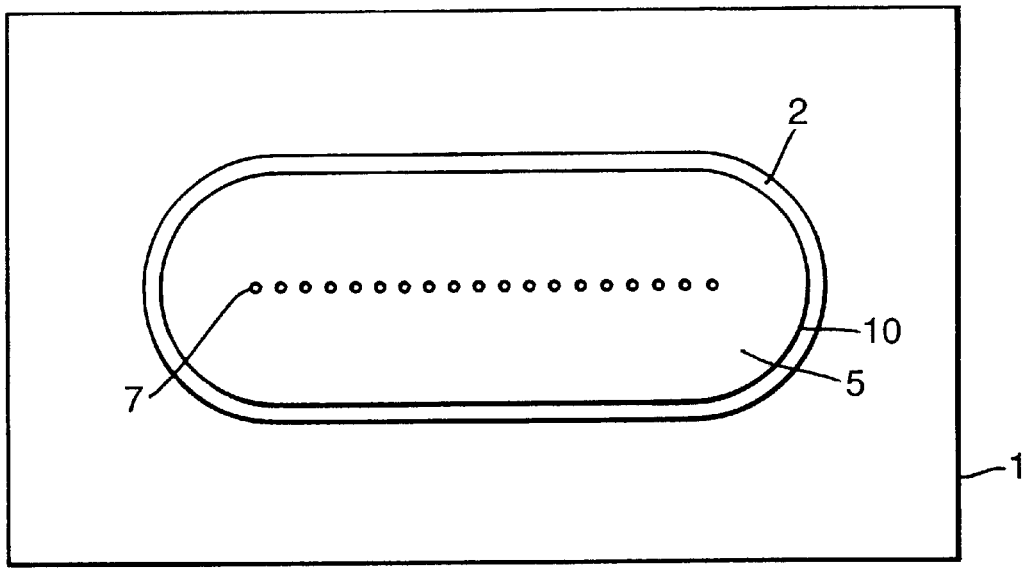

The base part of the generator, see FIG. 4, can be modeled as a pair of well coupled beams, one corresponding to carrier 5, the other to manifold 1. Let k be the wave number of the aforementioned bending wave motion of the carrier beam presented to the manifold beam. An extended beam (the manifold beam) excited with a force distribution having a wave number k, exhibits a wave impedance Z to the force as follows.

$$Z = \frac{4Elk^4\alpha}{\omega} + -j\left(\frac{Elk^4 - m\omega^2}{\omega}\right), \tag{1}$$

where E is Youngs modulus, I the second moment of inertia, m the mass/unit length, ω the angular frequency, and α the attenuation constant, all for the manifold beam. Equation (1) can be found in the text book 'Sound and Structural Vibration' by F. Fahey, Academic Press, 1985, and can be written Z=R+jX (see same equation earlier), where R(resistive component)=$4Elk^4\alpha/\omega$ and X(reactive component)=$((Elk^4-m\omega^2)/\omega)$. Elimination of the bending wave motion of carrier 5 is sought by maximizing Z. Thus, the material properties and dimensions of manifold 1 are chosen to maximize Z within the size constraints determined by other factors of the design.

What is claimed is:

1. A droplet generator for a continuous stream ink jet print head comprising: an elongate cavity for containing the ink; nozzle orifices communicating from within to outside of said cavity for passing ink from the cavity to form jets, said nozzle orifices extending along the length of said cavity; actuator means for vibrating the ink in said cavity such that each said jet breaks up into ink droplets at the same predetermined distance from its respective nozzle orifice, said actuator means being disposed on the opposite side of said cavity to said nozzle orifices; and extending between said actuator means and said nozzle orifices a surrounding wall of said cavity for containing the ink between said actuator means and said nozzle orifices, characterized in that said surrounding wall comprises inner and outer constituent walls, the resistive component of the wave impedance of said outer wall being such that the outer wall passively damps vibration of the inner wall by dissipating its vibration, the reactive component of the wave impedance of said outer wall being such that the outer wall actively restrains vibration of the inner wall, said outer wall thereby ensuring that each said jet breaks up into ink droplets at said same predetermined distance from its respective nozzle orifice.

2. A generator according to claim 1 wherein said actuator means is held in said generator by the outer wall of said surrounding wall.

3. A generator according to claim 1 or claim 2 wherein said cavity has a 'V' cross section defined by the interior faces of said inner wall, and said nozzle orifices extend along the open apex of said 'V' cross section cavity.

4. A generator according to claim 3 wherein said nozzle orifices are formed in a laminar sheet which is secured to said inner wall such that the nozzle orifices extend along said open apex of the 'V' cross section cavity.

5. A generator according to claim 1 wherein said actuator means overlaps the ends and sides of said cavity where it addresses the cavity.

6. A generator according to claim 1 wherein said outer wall is a single piece molded construction.

7. A generator according to claim 1 wherein said outer wall is constructed from at least two parts secured together.

8. A generator according to claim 1 wherein said actuator means and said inner wall are push fitted in said outer wall.

9. A generator according to claim 1 wherein said inner wall is metal and said outer wall is plastic.

10. A generator according to claim 1 wherein said actuator means is designed to be resonant in operation of the generator, whereas said cavity is designed not to be.

* * * * *